US012630982B2

(12) United States Patent
Wyatt

(10) Patent No.: US 12,630,982 B2
(45) Date of Patent: May 19, 2026

(54) RAIL FASTENING SYSTEM AND ASSOCIATED RAIL TRACK

(71) Applicant: Destec Pty Ltd, South Perth (AU)

(72) Inventor: Stephen Wyatt, South Perth (AU)

(73) Assignee: Destec Pty Ltd, South Perth (AU)

( * ) Notice: Subject to any disclaimer, the term of this patent is extended or adjusted under 35 U.S.C. 154(b) by 977 days.

(21) Appl. No.: 17/312,438

(22) PCT Filed: Dec. 9, 2019

(86) PCT No.: PCT/AU2019/051348
§ 371 (c)(1),
(2) Date: Jun. 10, 2021

(87) PCT Pub. No.: WO2020/118357
PCT Pub. Date: Jun. 18, 2020

(65) Prior Publication Data

US 2022/0056645 A1 Feb. 24, 2022

(30) Foreign Application Priority Data

Dec. 10, 2018 (AU) ..... 2018904694

(51) Int. Cl.
*E01B 9/34* (2006.01)
*E01B 5/02* (2006.01)
(Continued)

(52) U.S. Cl.
CPC ..... *E01B 9/34* (2013.01); *E01B 5/02* (2013.01); *E01B 9/32* (2013.01); *E01B 9/681* (2013.01);
(Continued)

(58) Field of Classification Search
CPC ... E01B 9/34; E01B 5/02; E01B 9/681; E01B 2201/08; E01B 2/003; E01B 9/32;
(Continued)

(56) References Cited

U.S. PATENT DOCUMENTS 35,879 A 7/1862 Lambaert
1,026,107 A * 5/1912 Morgan ..... E01B 3/18 238/42
(Continued)

FOREIGN PATENT DOCUMENTS

FR 441735 A 8/1912
GB 191207348 A 3/1913
(Continued)

OTHER PUBLICATIONS

European Patent Office Extended Search Report for Application No. 19894411.8 dated Aug. 31, 2022 (8 pages).
(Continued)

*Primary Examiner* — S. Joseph Morano
*Assistant Examiner* — Heaven R Buffington
(74) *Attorney, Agent, or Firm* — Michael Best & Friedrich LLP

(57) ABSTRACT

A rail fastening system (10) comprises a base plate (12) configured to sit on a support (14) and having a first recess 16 for receiving a length of a rail (18). The system (10) also includes a plurality of spring clips (**20*i*) and (20*t*) arranged to clamp the base plate (12) between the rail (18) and the support (14); and in doing so fasten the rail (18) to the support (14). A resilient rail pad (21) may be placed in the recess (16) prior to the recess receiving the rail (18), so that the rail (18) sits on top of the rail pad (21). The plate (12**) is not secured to the support before application of the clips. The clips are applied by pushing them over the base plate in direction perpendicular to the extent of the rail.

21 Claims, 4 Drawing Sheets

(51) Int. Cl.

| | |
|---|---|
| ***E01B 9/32*** | (2006.01) |
| ***E01B 9/68*** | (2006.01) |
| *E01B 2/00* | (2006.01) |
| *E01B 3/16* | (2006.01) |

(52) U.S. Cl.
CPC ..... *E01B 2/003* (2013.01); *E01B 3/16* (2013.01); *E01B 2201/08* (2013.01)

(58) Field of Classification Search
CPC ..... E01B 3/16; E01B 9/36; E01B 9/38; E01B 9/68; E01B 9/00; E01B 9/02; E01B 9/28; E01B 9/48
USPC ..... 238/217, 351, 349
See application file for complete search history.

(56) References Cited

U.S. PATENT DOCUMENTS

| | | | | |
|---|---|---|---|---|
| 1,026,108 | A | | 5/1912 | Morgan |
| 1,028,248 | A | | 6/1912 | Morgan |
| 1,063,374 | A | | 6/1913 | Morgan |
| 2,107,131 | A | | 2/1938 | Schwinn |
| 2,224,731 | A | | 12/1940 | Johnson |
| 2,944,739 | A | * | 7/1960 | Schwinn ..... E01B 13/02 238/217 |
| 2,954,169 | A | | 9/1960 | Rigby |
| 3,065,914 | A | | 11/1962 | Rigby |
| 3,957,201 | A | | 5/1976 | Johnson et al. |
| 4,515,309 | A | | 5/1985 | Gehrke |

FOREIGN PATENT DOCUMENTS

| | | | | |
|---|---|---|---|---|
| GB | 844720 | A | 8/1960 | |
| JP | 5436358 | B2 * | 3/2014 | ..... E01B 3/38 |

OTHER PUBLICATIONS

International Search Report and Written Opinion for Application No. PCT/AU2019/051348 dated Jan. 30, 2020 (9 pages).
International Preliminary Report on Patentability for Application No. PCT/AU2019/051348 dated May 24, 2021 (5 pages).
Canadian Patent Office Action for Application No. 3122587 dated May 5, 2025 (3 pages).
Austrailian Patent Office Action for Application No. 2019396125 dated Aug. 1, 2025 (6 pages).

* cited by examiner

RAIL FASTENING SYSTEM AND ASSOCIATED RAIL TRACK

TECHNICAL FIELD

A rail fastening system is disclosed for fastening rails such as used in a rail transport system to a support. Also disclosed is a rail track which may incorporate the rail fastening system.

BACKGROUND ART

A rail for a rail transport system is generally laid on and fastened to sleepers. There are different ways of attaching or fastening a rail to a sleeper. The rail division of The Delachaux Group markets a rail fastening system under the brand Pandrol which is widely used throughout the world. This fastening system includes a base plate that is attached by mechanical fasteners to an underlying sleeper and a clip that engages the base plate and bears on the rail to effectively hold the rail onto the base plate which in turn is fixed by the fasteners to the sleepers.

In using the Pandrol rail fastening system the base plates are first fastened to the sleepers and the rails are subsequently laid across the base plates. Next the clips are inserted which engage both the base plates and the rail. Tension in the clips determines the hold down force on the rails.

The above referenced the background art does not constitute an admission that the art forms a part of the common general knowledge of a person of ordinary skill in the art. Additionally the above reference is intended to limit the application of the rail fastening system and rail track as disclosed herein.

SUMMARY OF THE DISCLOSURE

In a first aspect there is disclosed a rail fastening system for fastening a rail to a support comprising:

- a base plate configured to sit on a portion of the support and having a first recess for receiving a length of a rail; and
- a plurality of spring clips each arranged to clamp the base plate between the rail and the support. Thus, in embodiments of this system it is the clips by themselves that retain the rails, and all other associate components, to the support. No other secondary restraining or fastening device or method is needed. There is no need to forms holes in otherwise penetrate the base plate or the support.

In one embodiment the base plate comprises a second recess configured to receive the portion of the support on which the base plate sits.

In one embodiment each clip has a first arm and a second arm, and wherein the first arm of the clip contacts the rail and the second arm of the clip contacts the support on a side opposite the base plate.

In one embodiment the first and second arms are configured to contact the rail and the support in a total of at least three locations.

In one embodiment the first arm is arranged to contact a rail at one location and the second arm is configured to contact the support at least two locations, and wherein each of the locations lie in different but mutually parallel planes.

In one embodiment a first plane containing the location of contact of the first arm on the rail lies between second and third planes each containing respective locations of contact of the second arm on the support.

In one embodiment the base plate comprises opposed side structures, each side structure having an upper edge and a cut out, wherein the cut out is dimensioned to receive one arm of a clip clamping the rail.

In one embodiment the base plate comprises at platform extending between the opposed side structure.

In one embodiment the side structures together straddle the portion of the support and between which is formed the second recess.

In one embodiment the cut out has a wall that slopes downwardly from an outside surface of a corresponding side structure to an inside surface of that side structure.

In one embodiment the platform has one surface that faces the support and an opposite surface that faces the rail, and wherein a lower most edge of the cut out is spaced in a direction perpendicular to the platform from the one surface by a distance sufficient to form a step between the lowermost edge and an under surface of a portion of a support received in the second recess.

In one embodiment the platform has a tapered thickness in a direction decreasing from an outside of the rail toward a gauge side of the rail.

In one embodiment each clip has a gap of a minimum dimension Gmm between the first and second arms when the clip is in a relaxed state, and a transverse distance between an upper edge of a side structure and a lower most edge of a cut out is Hmm wherein Gmm<Hmm.

In one embodiment the rail fastening system comprises a pad made from a resilient material arranged for location in the first recess between the rail and the base plate.

In a second aspect there is disclosed a method of fastening a rail to a support comprising:

- placing without securing a base plate on the support;
- placing the rail on the base plate;
- applying at least one clip over the rail and the support to fasten, by clamping, the rail and the base plate to the support.

In one embodiment applying the at least one clip comprises arranging the clip to contact the rail and the support in a total of at least three locations when the rail is fastened to the support.

In one embodiment applying at least one clip comprises pushing the clip over the base plate in a direction transverse to the rail.

In one embodiment applying at least one clip comprises resiliently expanding a gap between first and second arms of each clip to a dimension of Tmm to enable the clip to traverse a portion of the base plate and subsequently allowing the gap to spring back to a dimension of Gmm where Gmm<Tmm when respective in portions of the clip contact the rail and the support.

In a third aspect there is disclosed a rail track comprising:

- a rail configured to provide a running contact surface for a rail wheel of a rail vehicle;
- an elongate support extending parallel with the rail; and
- a plurality of rail fastening systems according to the first aspect for fastening the rail to the elongate support.

In one embodiment the support comprises a metal beam having a planar surface to which the rail is fastened by the plurality of rail fastening systems.

In one embodiment the metal beam is in the form of an I-beam or a H-beam, having two parallel surfaces and one transverse surface and orientated so that the base plate sit on one of the parallel surfaces.

In one embodiment the rail is one of a pair of parallel spaced apart rails and the elongate support is one of a pair of parallel spaced apart supports; and further comprising a plurality of transversely extending members connected to and between the pair of parallel spaced apart supports.

In one embodiment the rail track according comprises a plurality of columns on which the elongate supports are supported.

In one embodiment the rail track according comprises a resilient pad located between the elongate support and at least one of the columns.

rail fastening system for fastening a rail to a support comprising:

a base plate configured to sit on a portion of the support and having a first recess for receiving a length of a rail; and a plurality of spring clips each arranged to clamp the base plate between the rail and the support.

BRIEF DESCRIPTION OF THE DRAWINGS

Notwithstanding any other forms which may fall within the scope of the rail fastening system and rail track as set forth in the Summary, specific embodiments will now be described, by way of example only, with reference to the accompanying drawings in which.

DETAILED DESCRIPTION OF SPECIFIC EMBODIMENTS

Figure 1A:
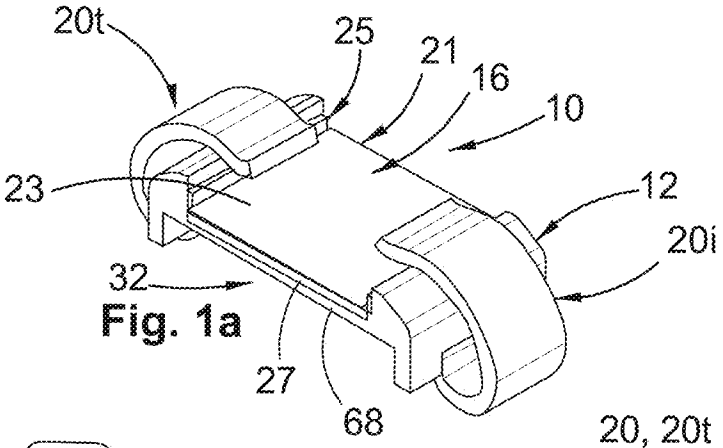
FIG. 1*a* is a perspective view of an embodiment of the disclosed rail fastening system.
Figure 1B:
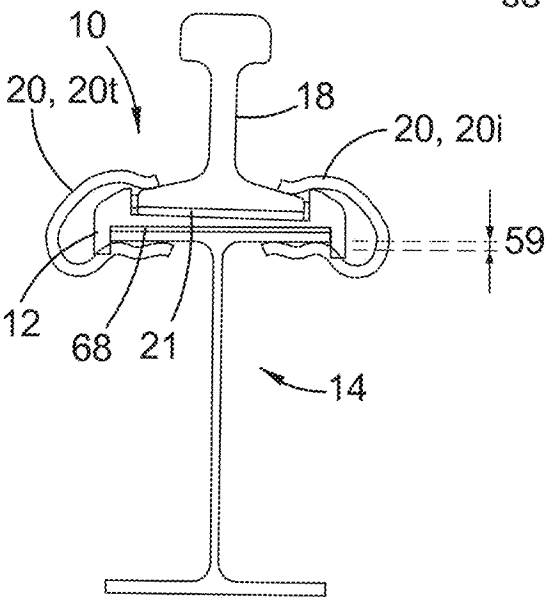
FIG. 1*b* is an end view of the rail fastening system shown in FIG. 1*a* fastening a rail to a support.
Figure 1C:
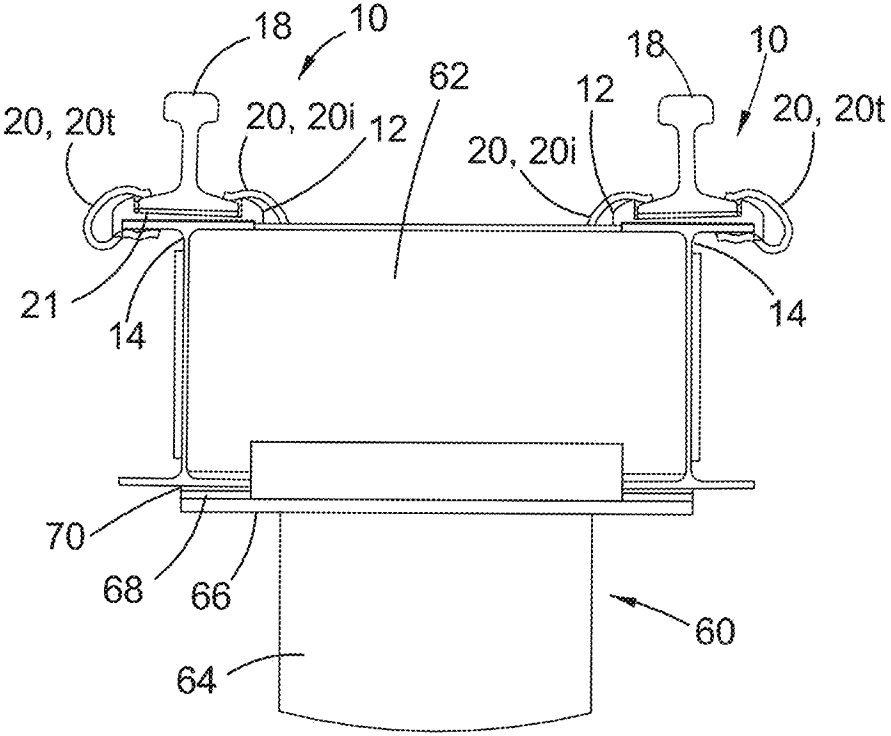
FIG. 1*c* is a schematic representation of embodiments of the disclosed rail fastening system in use fastening a rail to a support and forming and embodiment of the disclosed rail track.

Referring to FIGS. 1*a*-1*c* an embodiment of the disclosed rail fastening system 10 (hereinafter referred to in general as "system 10") comprises a base plate 12 configured to sit on a support 14 and having a first recess 16 for receiving a length of a rail 18. The system 10 also includes a plurality of spring clips 20*i* and 20*t* (hereinafter referred to in general as "spring clips 20"). The spring clips 20 are arranged to clamp the base plate 12 between the rail 18 and the support 14; and in doing so fasten the rail 18 to the support 14. As explained in more detail later, the clips are applied by pushing them over the base plate 12 in direction perpendicular to the extent of the rail 18. A resilient rail pad 21 may be placed in the recess 16 prior to the recess receiving the rail 18, so that the rail 18 sits on top of the rail pad 21.

Figure 2:
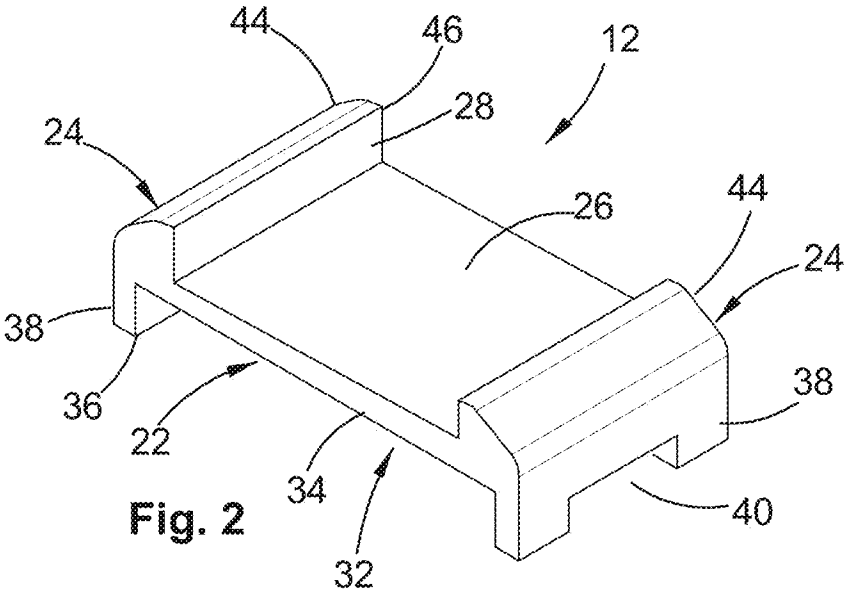
FIG. 2 is a perspective view of a base plate incorporated in the disclosed rail fastening system.
Figure 4:
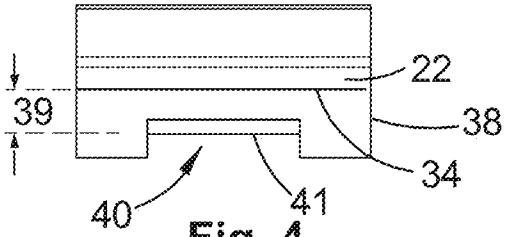
FIG. 4 is a side view of the base plate shown in FIG. 2.
Figure 3:
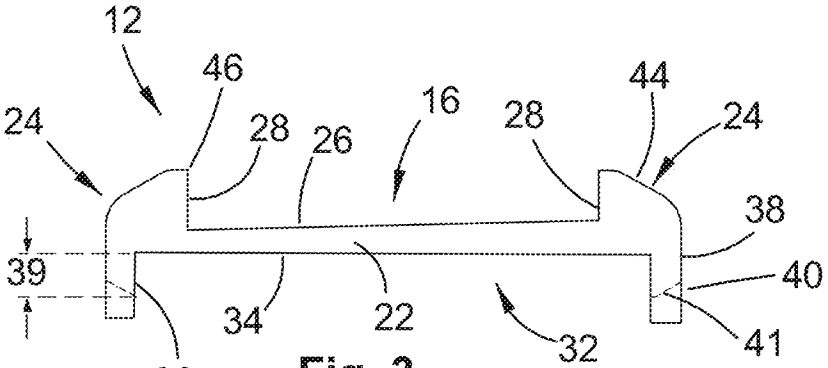
FIG. 3 is a front view of the base plate shown in FIG. 2.

The base plate 12 is shown by itself in FIGS. 2-4. The base plate 12 has a platform 22 that extends between two opposite side structures 24. The platform 22 is located intermediate of the height of the side structures 24. In this way the first recess 16 which receives the rail 18 is bound by an upper surface 26 of the platform 22 and opposed upper side surfaces 28 of the side structures 24.

This configuration of the platform 22 and the side structures 24 also forms a second recess 32 on the side of the platform 22 opposite the first recess 16. The second recess 32 is formed between an under surface 34 of the platform 22 and the inside surface 36 of lower side walls 38 of the side structures 24. Thus, the surface 26 faces the rail 18 while surface 34 faces the support 14.

As shown in FIGS. 1*b* and 1*c* the second recess 32 is configured to receive a portion of the support 14 on which the base plate 12 sits. The lower side walls 38 depend down opposite sides of the support 14 and thereby limit or prevent lateral movement of the base plate relative the support 14.

As shown in FIGS. 2-4 each lower side wall 38 is also formed with a respective cut out 40. The cut out 40 lies inboard of the longitudinal ends of the side wall 38. The cut out 40 has a wall 41 that slopes downwardly from an outside surface of the wall 38 to the inner surface 36. The bottom edge of the cut-out 40 (i.e. the wall 41) is formed below the under surface 34 of the platform 22. This forms a step 39 (see FIGS. 3 and 4) between the lower most edge upper surface of the cut outs 40 and the under surface 34 of the platform 22. The step 39 has a depth greater than the thickness of the support surface 14 (being a flange of a corresponding I-beam). As explained later below this has application in retaining the clips 20 once applied to the plate 12.

As is also evident from FIG. 3 the platform 22 has a tapered thickness in a direction decreasing from an outside of the rail 18 toward the gauge side of the rail 18. This tapering of thickness is formed by configuring the platform 22 so that the upper and under surfaces 16 and 34 are angled relative to each other. In this embodiment the angle between the upper and under surfaces 16 and 34 is in the order of 1.64°. Generally, in use the under surface 34 will lie in a substantially horizontal plane while the upper surface 16 will be angled relative to the horizontal plane. This gives an inclination of the rails to match the coning profile of the train wheels, and may be at a ratio of between 1:20 to 1:40 (1.43° to 2.86°)

Each side structure 24 has an upper portion with a generally curved outer surface 44. The surfaces 44 curve inwardly toward each other over the platform 22. Each outer surface 44 forms an edge 46 with a corresponding sidewall 28 of the respective sided structure 24. The side walls 28 are inside of the side walls 36. As a consequence, the first recess 16 has a smaller transverse width than the second recess 32. Further, the recesses 16 and 32 have a common midpoint, i.e. they are centred on each other.

Figure 5:
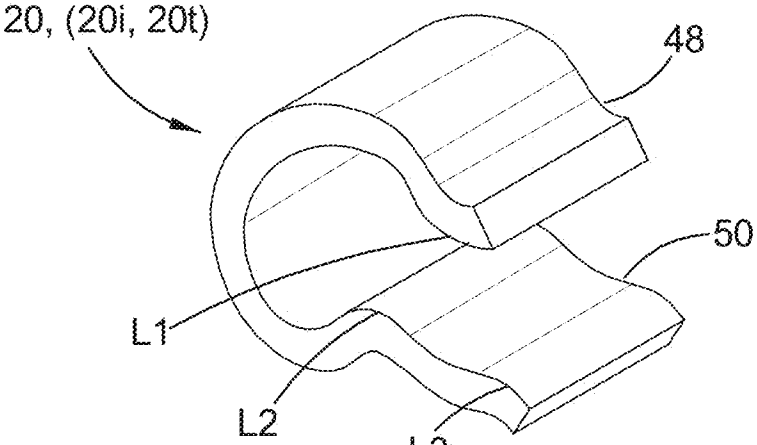
FIG. 5 is a perspective view of a rail clip incorporated in the rail fastening system.
Figure 6:
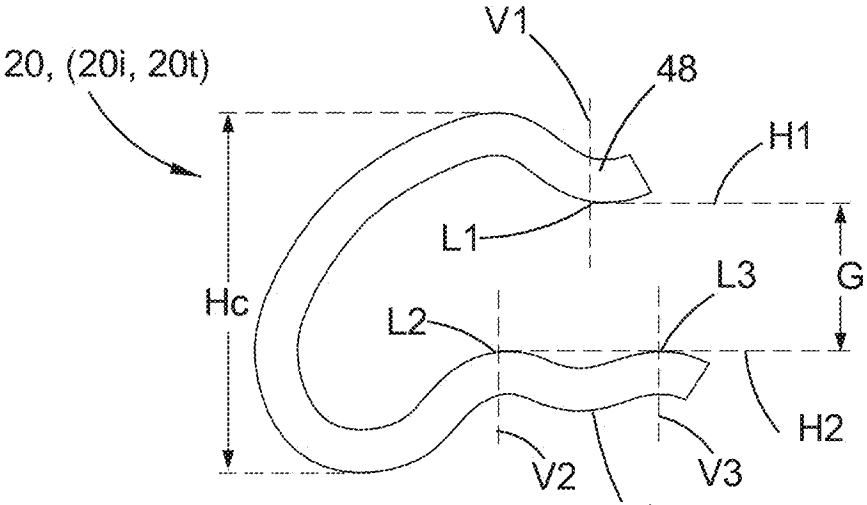
FIG. 6 is a side view of the rail clip shown in FIG. 5.

FIGS. 5 and 6 illustrate the clips 20 (20*i* and 20*t*) incorporated in an embodiment of the disclosed rail fastening system 10. The general configuration and the functional aspects of the clips 20*i* and 20*t* are identical. The only difference is a slight variation in the dimension of various portions of the clips 20*i* and 20*t*. This is manifested in the outside clip 20*t* having a height Hc in the order of about 2 mm greater than the corresponding height of the inner clip 20*i*. This is due at least in part to the variation in thickness of the platform 22 at opposite sides of the base plate 12. The clip 20*i* is an "inside" clip in that it is applied on the inside (i.e. the gauge side) of a corresponding rail 18; while the clip 20*t* is an "outside" clip in that it is applied to an outside of the corresponding rail 18.

Each clip 20 is configured to contact the rail 18 and the support 14 in at least three locations. In this embodiment each clip 20 is arranged to contact the rail 18 at one location and contact the support 14 at two locations. Each of these locations lie in different but parallel planes. In the illustrated embodiment these planes are vertically orientated.

Each clip 20 has general configuration in the shape of a letter "C", or a "U" turned through 90° and has two arms 48 and 50. The first arm 48 is arranged to contact the rail 18 at one location. This location coincides with a point or region L1 formed on the inside surface of the clip 20 on the arm 48. The point L1 is a lowest point on a convex curve on the inside surface of the clip 20 on the arm 48.

The second arm 50 is arranged to contact the support 14 at two locations which correspond with the points/regions L2 and L3 on an inside surface of the clip 20. The points L2 and L3 are at the crest of respective concave curves on the inside surface. The locations L1, L2 and L3 are offset from each other so that corresponding planes containing these points do not coincide. When the clips 20 are in a "use" orientation, i.e. when applied to retain a rail 18 to a support 14 for a rail transport system, these planes are vertical planes. Therefore, with reference to the use orientation, a vertical plane containing the point L1 is located between respective vertical planes containing the points L2 and L3. The vertical planes containing the points L1, L2 and L3 are shown in FIG. 6 as planes V1 and V2 and V3 respectively.

Thus, each clip 20 provides three points L1, L2, L3 of contact that retain the rail 18 to the support 14 via the base plate 12. Between these three points the: support 14; the base plate 12; the resilient pad 21; and, the rail 18 are secured. The clips 20 at locations L1, L2 and L3 are provided with tight radii to ensure the three-point contact. These also provide mechanisms which interact with the base plate 12 and the support 14 to assist in preventing the clips 20 from disengaging when the system 10 is in use.

Again, with reference to the use orientation of the clip 20, and as shown in FIG. 6, the location L1 lies on a horizontal plane H1. The locations L2 and L3 line on a common second horizontal plane H2. The perpendicular (in this case vertical) distance G between the planes H1 and H2 defines the gap size between the arms 48, 50 and hence the gap size of the clip 20 when in the relaxed condition, i.e. prior to being applied to clamp the rail 18 to the support 14. The base plate 12 is configured so that when a clip 20 is pushed onto the base plate 12 and contacts the rail 18 and the support 14, the distance between the horizontal planes H1 and H2 is increased to a distance T where T>G. What this means of course is the gap size G must increase when the clip 20 is in use fastening the rail 18 to the support 14 so that the clip 20 is in tension and applying a clamping force between the rail 18 and the support 14.

Typical force values of a clip 20 at various openings from a preset gap opening (from actual testing and FEA analysis) are as follows:

Starting gap G of 35 mm=0 kg of force; i.e. the clip 20 is in the relaxed state Opening gap G to 36 mm=160 kg of force Opening gap G to 37 mm=320 kg of force Opening gap G to 38 mm=500 kg of force Opening gap G to 39 mm=680 kg of force Opening gap G to 40 mm=880 kg of force Opening gap G to 41 mm=1100 kg of force Opening gap G to 42 mm=1330 kg of force Opening gap G to 43 mm=1620 kg of force (this still provides consistent clip memory back to original gap size)

The degree of opening of the gap G, and therefore the clamping force applied by the clips 20 when in use fastening a rail 18 to a support 14 can be varied by using rail pads 21 of different thickness and/or using additional shims located either in one of both of the first recess 16 and the second recess 32.

It is believed that application of a force of about 1000 kg per clip 20, with two clips per fastening system 10 (i.e. a clip 20*i* and a clip 20*t*) with a spacing of about 500 mm to 600 mm between base plates 12 will meet all engineering requirements for at least a consist used for the transport of bulk commodities. It will be recognised that it is the clips 20 alone that retain the rails 18 to the support 14. This is achieved by a simple one direction motion of the clip being pushed toward the middle of the based plate 12 perpendicular to the direction of extent of the rails. There is no need to use any other fastener, there is no need to penetrate the rail 18, the base plate 12 or the support 14. There is no need to engage a clip by for example inserting one part in recess or opening formed on the base plate and then swinging the clip about that one part to snap over the base plate.

The edge 46 of the base plate 12 is higher than the surface of the rail 18 contacted by the clips 20 at location L1. Therefore, after the clip 20 has been sprung open to traverse the edge 46 during application, it springs back to reduce the gap size so that the edge 46 now acts to prevent the clips 20 from coming off the rail 18. Normally the location L1 is inward of the edge 46 so they do not directly engage each other. However, the curved portion of arm 48 at L1 may engage the edge 46 if for some reason the curved portion of arm 50 at L2 has traversed back over a step 59. In this way the engaging of the location L1 with the step 46 is a secondary safety holder for the clip 20.

Also, as mentioned above the depth of the step 39 is greater than the thickness of the flange of the support 14 (i.e. I beam) on which the base plate 12 sits. Therefore, there remains a step 59 (see FIG. 1*b*) over which the clips 20 must be sprung open when being applied to the base plate 12 for retaining the rail 18. Once the arm 50 of the clip has traversed this step 59 it springs back to reduce its gap size G. The step 59 now acts to retain the clips 20 on the base plate 12. Indeed, this retention of the clip at location L2 against the step 59 is the primary holder for the clip 20.

Thus, the edge 46 and the step 59 both act to retain the clips 20 from being pushed off the base 12 in a direction opposite to which they are applied. Additionally, the nature of the cut out 40 being inboard of the sidewall 38 prevents the clips 20 from slipping in a direction of the rail 18 off the base plate 12.

Figure 7:
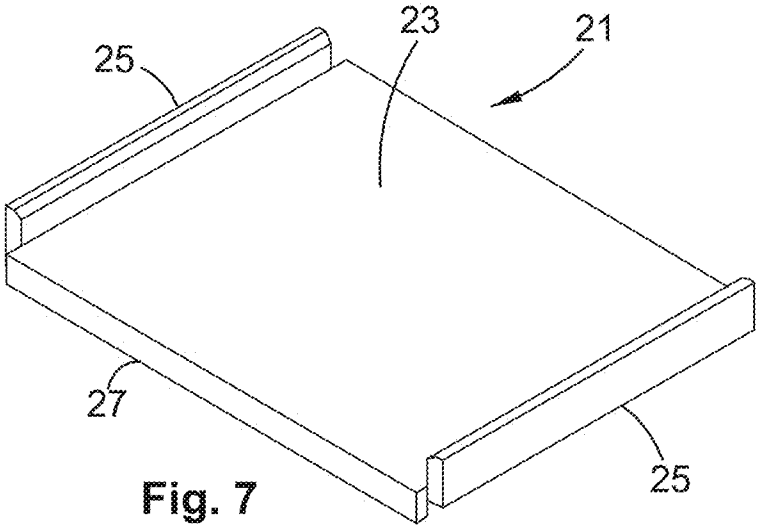
FIG. 7 is a perspective view of a pad incorporated in an embodiment of the disclosed rail fastening system.
Figure 8:
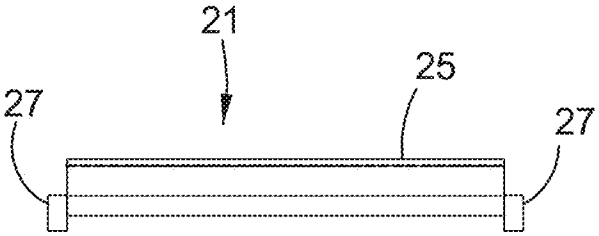
FIG. 8 is a side view of the pad shown in FIG. 7.
Figure 9:
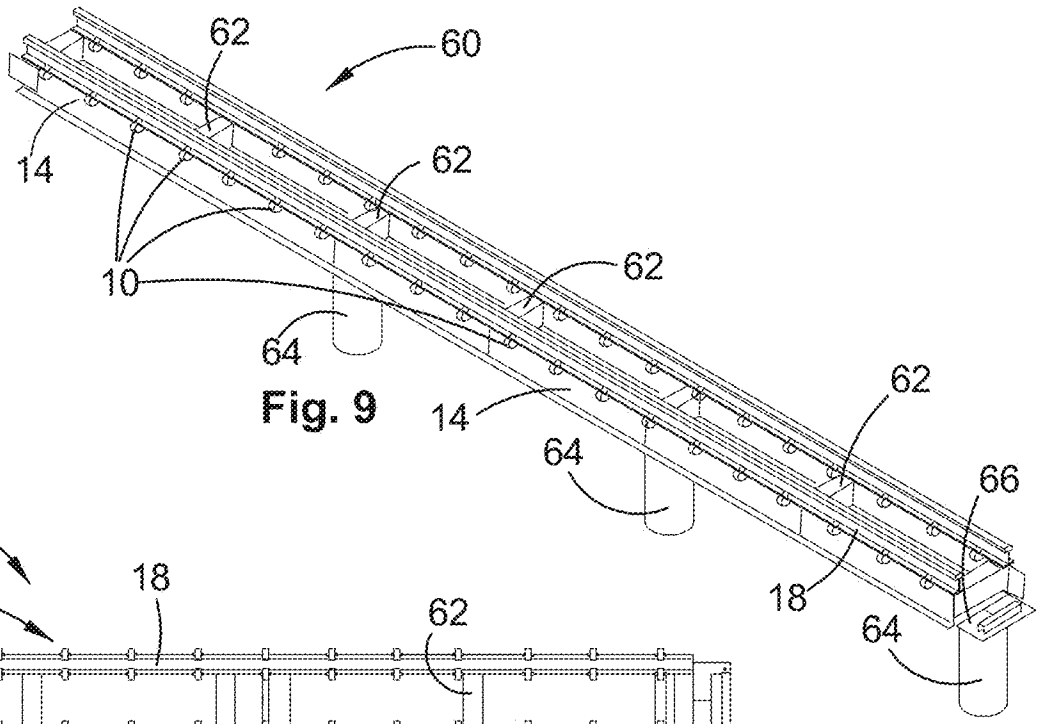
FIG. 9 is a perspective view of a rail track that incorporates the rail fastening system shown FIGS. 1*a*-1*c;*
Figure 10:
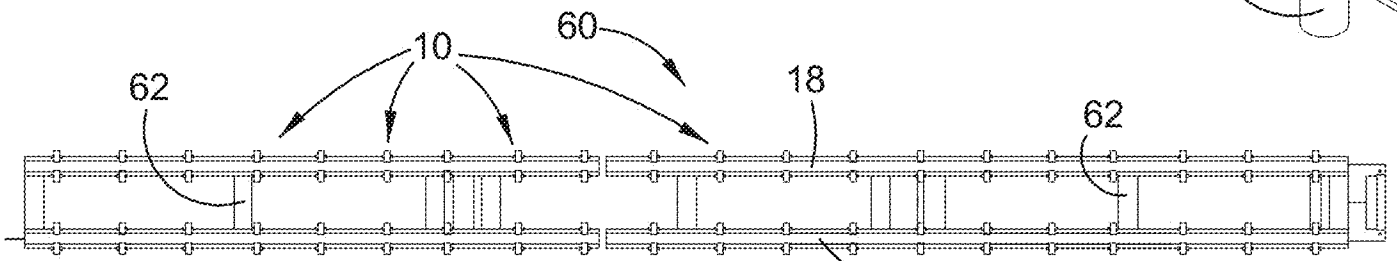
FIG. 10 is a plan view of the rail track shown FIG. 9.
Figure 11:
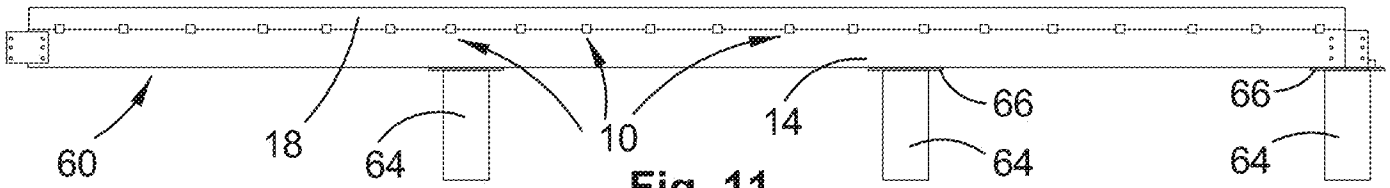
FIG. 11 is a side view of the rail fastening system shown FIG. 9.

FIGS. 7 and 8 depict one form of the pad 21 that may be used in the system 10. The pad 21 is made from a resilient material and comprises: a planar sheet portion 23 that sits on top of the platform 22; together with, a pair of opposed upstanding walls 25; and, a pair of depending opposed lips 27. The upstanding walls 25 lie adjacent the upper side surfaces 28 of the side structures 24. Therefore, when in use the side walls 25 are on opposite sides of the rail 18. The lips 27 overhang the side walls of the platform 22 and thereby assist to retain and prevent the pad 21 from slipping off the base plate 12 when the rail 18 is being applied.

FIGS. 1*c* and 9-11 show an embodiment of the disclosed rail track 60 having a plurality of the rail fastening systems 10. The rail track 60 has two parallel and spaced apart rails 18 to provide the contact surfaces for respective rail wheels of a rail vehicle. For each of the rails 18 there is an elongate support 14 that extends parallel with the corresponding rail 18, the rails 18 being fastened to the supports surfaces 14 by the plurality of the rail fastening systems 10.

In this embodiment each of the supports 14 is a metal beam having a planar surface to which a respective rail 18 is fastened by a plurality of the rail fastening systems 10. The metal beams are I-beams, or indeed could be considered to be H-beams which are orientated so that the "legs" of the H-beams lie substantially horizontally. Such I and H beams are also known as universal beams.

So, the rail track 60 is a dual rail track having a pair of rails 18, each supported on an I beam 14, where rails 18 are fastened to the I beams 14 by a plurality of the rail fastening systems 10. Rather than sleepers as in a conventional dual rail track, the disclosed rail system 60 is formed with a plurality of transversely extending members 62 that connect the supports 14 together. In contrast to a conventional rail track, the rails 18 are not fastened to the members 62. The members 62 are conveniently short lengths of the same universal beam used to form the supports 14.

In this embodiment the rail track 60 also includes a plurality of columns 64 on which the universal beams 14 are supported thereby elevating the rails 18 above the ground.

Referring to FIG. 1*c* an interface plate 66 is fixed on top of each column 64. The universal beams 14 are supported on the interface plate 66. In order to assist in levelling of the rail system 60 a metal packer/shim 68 may be provided between the interface plate 66 and the overlying universal beams. Additionally, a resilient pad 70 may be provided between the interface plate 66 or the metal packer and the overlying universal beams.

It should be appreciated that when embodiments the disclosed system 10 are used the base plate 12 is only secured to the support 14 by the clips, that is the base plate 12 is not retained on the support until the clips 20 are applied. Thus, the fastening of the base plate 12 to the support 14 occurs simultaneously with the fastening of the rail 18 to the support 14. This is to be contrast with the Pandol rail fastening system in which the corresponding base plate is fastened separately by mechanical fasteners to underlying sleepers before the clips are applied.

Whilst a specific embodiment of the rail fastening system and rail track have been described, it should be appreciated that system and track maybe embodied in many other forms. For example, the rail track 60 is disclosed as a dual rail track elevated above the ground. However, the rail track could be a monorail which would therefore comprise only a single rail and a single support/universal beam 14. The illustrated embodiment of the rail fastening system 10 shows the use of two clips 20 per base plate 12. However, the base plates could be extended to receive four clips, two on each side. Also, while the clips 20 could be configured to provide four contact points between the rail 18 in the support 14, for example by having to contact points on the rail 18.

In the claims which follow, and in the preceding description, except where the context requires otherwise due to express language or necessary implication, the word "comprise" and variations such as "comprises" or "comprising" are used in an inclusive sense, i.e. to specify the presence of the stated features but not to preclude the presence or addition of further features in various embodiments of the rail fastening system and rail track as disclosed herein.

The invention claimed is:

1. A rail fastening system for fastening a rail to a support, the rail fastening system comprising:

a base plate configured to sit on a portion of the support, the base plate having a first recess for receiving a length of the rail, the base plate comprising opposed side structures, each side structure having an upper edge and an inboard cut out defining a step; and a plurality of spring clips each arranged to clamp the base plate between the rail, and the support, each clip having a first arm and a second arm, the first arm of the clip arranged to contact the rail at a first location and the second arm of the clip configured to contact the support on a side opposite the base plate at two spaced apart locations;

wherein:

the upper edges of the base plate are higher than the surfaces of the rail where the rail is contacted by the first arms of the clips, the upper edges of the base plate being configured to contact the first arm of a respective spring clip with outward motion of the first arm relative to the base plate to inhibit outward motion of the clip with respect to the base plate;

the second arm of each clip is configured to extend through a respective one of the cut outs, thereby inhibiting slipping of the clips in a longitudinal direction of the rail; and a depth of the steps is greater than a thickness of the support where the support is contacted by the second arms of the clips such that the steps inhibit outward motion of the clips with respect to the base plate.

2. The rail fastening system according to claim 1 wherein each of the locations lie in different, mutually parallel planes.

3. The rail fastening system according to claim 2 wherein a first plane containing the first location of contact of the first arm on the rail lies between second and third planes each containing respective locations of contact of the second arm on the support.

4. The rail fastening system according to claim 1 wherein the base plate comprises: a platform extending between the opposed side structures; a second recess configured to receive the portion of the support on which the base plate sits; and the side structures together straddle the portion of the support and between which is formed the second recess.

5. The rail fastening system according to claim 4 wherein the platform has one surface that faces the support and an opposite surface that faces the rail, and wherein a lowermost edge of the cut out is spaced in a direction perpendicular to the platform from the one surface by a distance sufficient to form the step between the lowermost edge and an under surface of a portion of a support received in the second recess.

6. The rail fastening system according to claim 4 wherein the platform has a tapered thickness in a direction decreasing from an outside of the rail toward a gauge side of the rail.

7. The rail fastening system according to claim 4 wherein each clip has a gap of a minimum dimension Gmm between the first and second arms when the clip is in a relaxed state, and a transverse distance between an upper edge of a side structure and a lowermost edge of a cut out is Hmm wherein Gmm<Hmm.

8. The rail fastening system according to claim 1 wherein the cut out has a wall that slopes downwardly from an outside surface of a corresponding side structure to an inside surface of that side structure.

9. The rail fastening system according to claim 1 comprising a pad made from a resilient material arranged for location in the first recess between the rail and the base plate.

10. A rail track comprising:

a rail configured to provide a running contact surface for a rail wheel of a rail vehicle;

an elongate support extending parallel with the rail; and a plurality of rail fastening systems according to claim 1 for fastening the rail to the elongate support.

11. A rail track comprising:

a rail configured to provide running contact surfaces for rail wheels of a rail vehicle;

an elongate support extending parallel with and underlying the rail;

a plurality of rail fastening systems for fastening the rail to the underlying elongate support, each rail fastening system having a base plate configured to sit on a portion of the support and having a first recess for receiving a length of a rail; and a plurality of spring clips arranged to clamp the base plates between the rail and the underlying support, wherein:

the spring clips are arranged to be applied in a direction transverse to the rail and the support;

each clip of the plurality of spring clips has a first arm and a second arm, wherein the first arm is configured to contact the rail at a first location and the second arm is configured to extend through a cut out in the base plate to contact the underlying elongate support on a side opposite the base plate to the rail at two spaced apart locations; and the base plate comprises a first holder and a second holder for each spring clip, the first holder being configured to inhibit outward motion of the respective spring clip with respect to the base plate and the second holder being configured to contact the second arm of the respective spring clip to inhibit outward motion and longitudinal motion of the respective spring clip with respect to the base plate.

12. The rail track according to claim 11 wherein the support comprises a metal beam having a planar surface to which the rail is fastened by the plurality of rail fastening systems.

13. The rail track according to claim 12 wherein the metal beam is in the form of an I-beam or a H-beam, having two parallel surfaces and one transverse surface and orientated so that the base plate sits on one of the parallel surfaces.

14. The rail track according to claim 11 wherein the rail is one of a pair of parallel spaced apart rails and the elongate support is one of a pair of parallel spaced apart supports; and further comprising a plurality of transversely extending members connected to and between the pair of parallel spaced apart supports.

15. The rail track according to claim 11 comprising a plurality of columns on which the elongate supports are supported.

16. The rail track according to claim 15 comprising a resilient pad located between the elongate support and at least one of the columns.

17. The rail track according to claim 11 wherein each of the two spaced apart locations lie in different, mutually parallel, vertical planes.

18. The rail track according to claim 17 wherein a first plane containing the first location of contact of the first arm on the rail lies between second and third planes each containing respective locations of contact of the second arm on the support.

19. A rail fastening system for fastening a rail to a support, the rail fastening system comprising:

a base plate configured to sit on a portion of the support and having a first recess for receiving a length of the rail; and a plurality of spring clips each arranged to clamp the base plate between the rail and the support;

wherein:

each clip has a first arm and a second arm, one of the first arm and the second arm arranged to contact the rail at a first location and the other of the first arm and the second arm arranged to extend through a cut out in the base plate to contact the support on a side opposite the base plate to the rail at two spaced apart locations;

the base plate comprises a first holder that is configured to contact the first arm of a respective one of the spring clips with outward motion of the first arm relative to the base plate, to inhibit outward motion of the spring clip with respect to the base plate; and the base plate comprises a second holder that is configured to contact the second arm of the respective one of the spring clips to inhibit outward motion and longitudinal motion of the spring clip with respect to the base plate.

20. The rail fastening system of claim 19, wherein the second holder is outwardly displaced with respect to the first holder.

21. A rail track comprising:

a rail configured to provide a running contact surface for a rail wheel of a rail vehicle;

an elongate support extending parallel with the rail; and a plurality of rail fastening systems according to claim 19 for fastening the rail to the elongate support.

* * * * *